United States Patent [19]

Anderson

[11] Patent Number: 4,657,333

[45] Date of Patent: Apr. 14, 1987

[54] SAFETY ELECTRICAL RECEPTACLE

[76] Inventor: Carlton Anderson, 911 E. Wilshire Ave., Fullerton, Calif. 92631

[21] Appl. No.: 230,444

[22] Filed: Feb. 2, 1981

[51] Int. Cl.[4] ..... H01R 13/50

[52] U.S. Cl. ..... 339/164 R; 339/225 P

[58] Field of Search ..... 339/164, 255 R, 255 P

[56] References Cited

U.S. PATENT DOCUMENTS 2,706,803 4/1955 Templeton ..... 339/255 R X 2,770,786 11/1956 Czyzewski ..... 339/164 R X

FOREIGN PATENT DOCUMENTS 465719 6/1950 Canada ..... 339/164 R

*Primary Examiner*—Timothy V. Eley

*Attorney, Agent, or Firm*—Francis X. LoJacono

[57] ABSTRACT

An electrical receptacle having at least one plug-receiving receptacle socket comprising a two-piece housing having contact fingers which are spring biased against a center post of the housing by a coil spring. The coil spring is interposed between the ends of a flexible shunt member which electrically interconnects the contact finger with the bus-bar member, the bus-bar member having suitable wire-connecting screws. Thus, the load force on the contact fingers prevents accidental removal of a typical two-prong electrical plug when positioned in the receptacle socket.

2 Claims, 6 Drawing Figures

FIG. 1
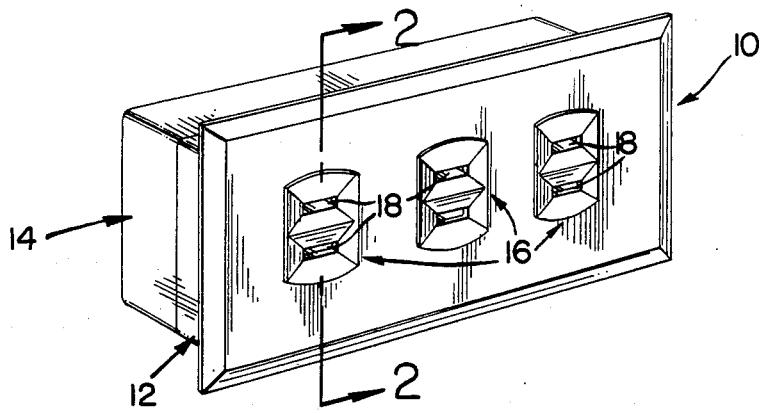
FIG. 5
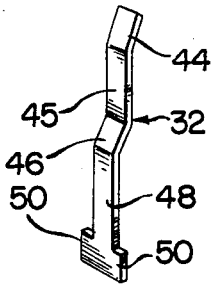
FIG. 2
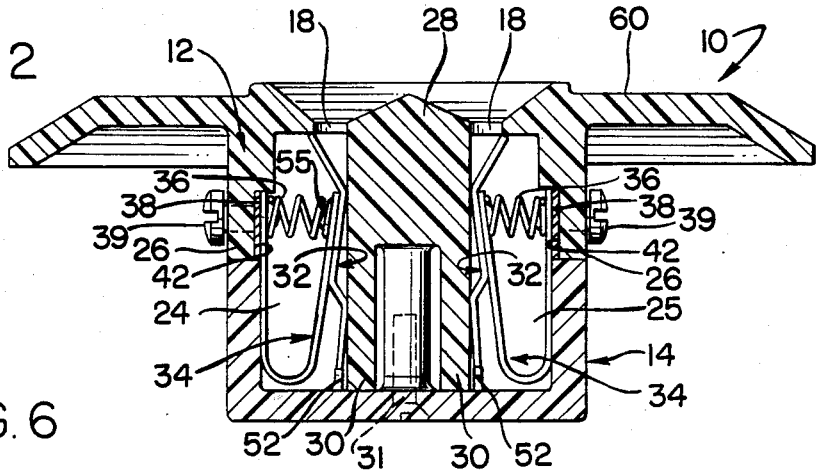
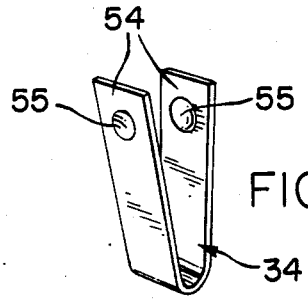
FIG. 6
FIG. 4
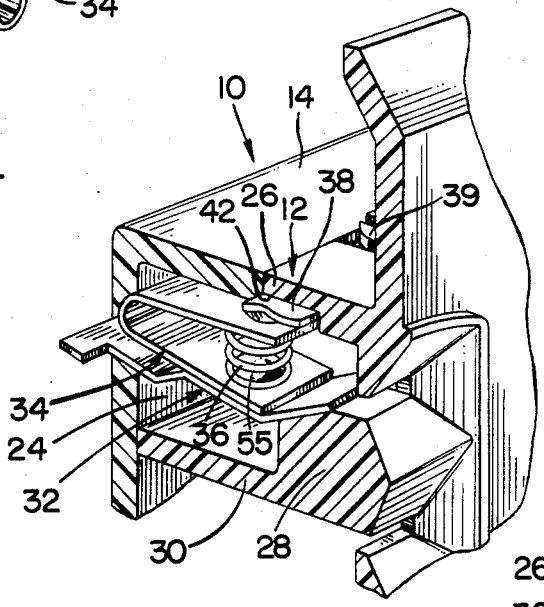
FIG. 3
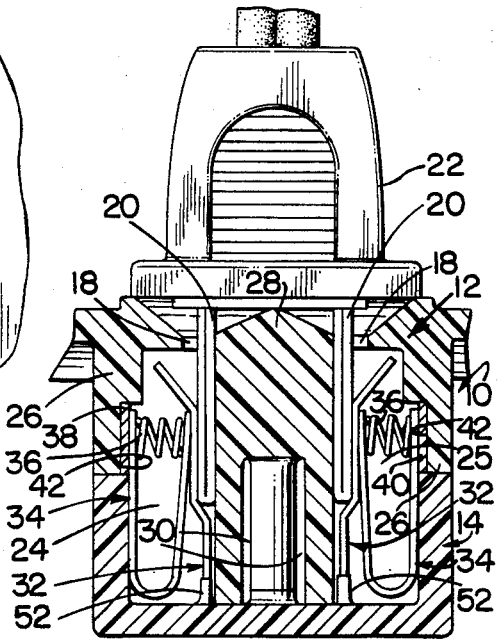

SAFETY ELECTRICAL RECEPTACLE

BACKGROUND OF THE INVENTION

1. Field of the Invention

This invention relates generally to an electrical receptacle for receiving electrical plugs, and more particularly to a safety receptacle that allows a plug to be held under force within the receptacle, whereby the plug cannot be removed accidentally or be tampered with by small children.

2. Description of the Prior Art

It is well known in the art that various problems and difficulties are encountered in providing a suitable means for preventing the inadvertent removal of electrical plugs from a receptacle socket. There is and has been a continuous problem with small children playing with electrical outlets and their associated electrical plugs and cords.

Several types of locking plugs as well as safety receptacles have been tried. However, these devices have features that very often restrict their use to certain areas or conditions. They also are frequently complicated to operate and expensive to maintain Thus, for one particular reason or another, the known devices have not met with widespread acceptance for use.

SUMMARY AND OBJECTS OF THE INVENTION

The present invention has for an important object to provide a safety electrical receptacle that is compatible with most known and presently used male plugs associated with various electrically operated apparatuses such as lamps, appliances, etc.

Accordingly, the present device comprises an electrical receptacle adapted to be mounted to known outlet boxes, and includes spring-biased contact fingers which are normally held against a central post formed in the housing. These fingers are forced outwardly when the prongs of a male plug are inserted through the socket openings. Thus, the prongs of the plug are held frictionally due to the spring load provided by a coil spring interposed between the contact bus bar and the flexible finger. However, in order to establish a positive electrical flow between the bus bar and each finger, there is provided a flexible shunt member that interconnects the bar and the respective contact finger.

It is another object of the invention to provide a safety electrical receptacle or outlet that can be made having one or more outlet sockets that are adaptable for use in conventional, wall-mounted, electrical-outlet boxes.

It is still another object of the invention to provide a safety electrical receptacle having relatively few operating parts.

It is a further object of the invention to provide a device of this character that will prevent the inadvertent removal of an electrical plug, or removal of a plug by a small child.

It is still a further object of the invention to provide a device of this character that is simple and rugged in construction, and inexpensive to manufacture.

The provision of the component parts of the present device have been designed to establish an improved safety electrical receptacle or outlet that can be easily assembled with no special tools at a relatively low cost and with a minimal amount of labor expenditure.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of the present invention indicating a plurality of outlet sockets;

FIG. 2 is an enlarged cross-sectional view taken substantially along line 2—2 of FIG. 1;

FIG. 3 is a similar cross-sectional view including a typical male electrical plug mounted within the outlet socket wherein the contact fingers are forceably engaging the prongs of the plug;

FIG. 4 is a pictorial cross-sectional view of a portion of the present invention;

FIG. 5 is a perspective view of a contact finger; and

FIG. 6 is a perspective view of a shunt member.

DESCRIPTION OF THE PREFERRED EMBODIMENT

The following description is provided to enable skilled persons in the art to make and use the present invention, and sets forth herein the preferred modes and arrangements contemplated by the inventor in carrying out the invention.

Referring more particularly to the drawing, there is shown in FIG. 1 an electrical receptacle or outlet, generally indicated at 10, having a housing defined by the main body structure 12 and a rear cover member 14. The body structure 12 is formed having a generally rectangular configuration, whereby one or more outlet sockets 16 can be provided. Each outlet socket 16 is defined by a pair of typical openings 18 adapted to receive a pair of male prongs 20 of any well known electrical male plug member 22, such as shown in FIG. 3. Openings 18 allow passage of prongs 20 of plug 22 to enter respective compartments 24 and 25 formed in main body 12, the compartments being defined by side walls 26 and contiguous center post 28 and partitions 30, together with the rear cover 14. It should be noted that cover 14 may be fixedly secured to body 12 or it may be provided with a screw 31, so as to be removably mounted.

Accordingly, compartments 24 and 25 are identically arranged to receive a biased electrical contacting means which comprises a contact finger 32, connecting shunt 34, and a biasing means represented by coil spring 36. Further arranged to be exposed within each compartment are oppositely disposed bus bars 38 and 40. When there are a plurality of sockets, such as seen in FIG. 1, each bus bar extends longitudinally along with the recess 42 formed therein.

Contact finger 32 is formed by a substantially flat metal strip having an outwardly turned lip 44 positioned just below opening 18 of inlet 16. A midsection 45 extends downwardly adjacent post 28, and establishes the contact area between shunt 34 and plug prongs 20. The midsection 45 is bent inwardly at 46 to provide an offset of the midsection 45.

The terminating end section 48 is provided with laterally extended ears 50 which are positioned to be received in oppositely disposed grooves 52 formed within the respective compartments 24 and 25. Thus, before cover 14 is positioned and attached to body 12, finger 32 is inserted in the compartments, ears 50 being located in grooves 52. Then, shunt 34 is inserted into place along with spring 36.

Shunt 34 comprises a second metal strip which is bent in a substantially "U"-shaped configuration and having oppositely arranged free ends 54, the free ends being formed with inwardly projecting bosses 55 that are adapted to support coil spring 36 between the free ends 54. Thus, shunt 34 is flexibly positioned between finger 32 and bus bar 38. The coil spring can be made from any suitable high-conductive metal. However, it is contemplated that for best results a beryllium copper could be used to form the spring. Bus bars are also provided with one or more wire-connecting screws 39.

Referring to FIG. 3, there is shown plug 22 inserted in socket 16, the prongs 20 being forceably held in electrical contact between the fingers 32 and the post 28. The post, as with the rest of body 12 and cover 14, is formed from any suitable non-conductive material such as rubber or plastic.

It should be further noted that body 12 is shown having an integral face plate 60. However, such a face plate can be readily formed as a separate part thereof, as is often found in the art.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A safety electrical receptacle having at least one socket outlet formed therein including openings to receive prongs of a male electrical plug, said receptacle comprising:

a main body member in which said socket outlet is formed;

a pair of oppositely disposed compartments insulated one from the other, and defining said socket outlet;

a contact finger mounted in each of said compartments, in alignment with said openings, wherein said contact fingers are formed from an elongated metal strip having an outwardly turned lip member on one end thereof, and laterally extended ear members formed on the opposite end thereof;

a pair of bus-bar members, each member being mounted to be exposed in corresponding compartments;

electrically conductive biasing means defined by springs interposed between said bus bars and said respective contact fingers;

means for connecting electrical wiring to said bus bars;

an electrically conductive shunt member adapted to interconnect said bus bar with said contact finger, said shunt member comprising a metal strip bent in a substantially "U"-shaped configuration forming oppositely arranged free ends, and wherein one end contacts said bus bar and the opposite end contacts said contact finger, said coil spring being interposed between said free ends whereby a load force is provided against said contact finger;

said compartments including means for positioning said contact fingers to engageably receive said prongs of said male plug, so as to hold said plug in a substantially fixed position within said socket, and said finger-positioning means comprising a pair of oppositely disposed grooves adapted to receive said ears of said contact fingers.

2. A safety electrical receptacle as recited in claim 1, wherein said receptacle includes a cover member adapted to be secured to said main body member thereof.

* * * * *